US007779914B2

(12) United States Patent
Latimer

(10) Patent No.: US 7,779,914 B2
(45) Date of Patent: Aug. 24, 2010

(54) PROCESS FOR PRODUCING HEAVY OIL

(75) Inventor: Edward G. Latimer, Ponca City, OK (US)

(73) Assignee: ConocoPhillips Company, Houston, TX (US)

( * ) Notice: Subject to any disclaimer, the term of this patent is extended or adjusted under 35 U.S.C. 154(b) by 17 days.

(21) Appl. No.: 12/331,955

(22) Filed: Dec. 10, 2008

(65) Prior Publication Data

US 2010/0139922 A1 Jun. 10, 2010

(51) Int. Cl.
*E21B 43/24* (2006.01)
*E21B 43/40* (2006.01)

(52) U.S. Cl. ..... 166/272.3; 166/267; 166/303; 166/371

(58) Field of Classification Search ..... None
See application file for complete search history.

(56) References Cited

U.S. PATENT DOCUMENTS

| | | | | |
|---|---|---|---|---|
| 4,684,372 | A | 8/1987 | Hayes et al. | |
| 5,283,001 | A | 2/1994 | Gregoli et al. | |
| 5,411,558 | A | 5/1995 | Taniguchi et al. | |
| 2004/0055208 | A1 * | 3/2004 | Chakrabarty et al. | 44/301 |
| 2006/0027488 | A1 | 2/2006 | Gauthier | |
| 2006/0042999 | A1 | 3/2006 | Iqbal et al. | |
| 2006/0243448 | A1 | 11/2006 | Kresnyak et al. | |

FOREIGN PATENT DOCUMENTS

| | | | |
|---|---|---|---|
| CA | 2404586 | A1 | 3/2004 |
| WO | WO 2006/060917 | A1 | 6/2006 |

* cited by examiner

*Primary Examiner*—Zakiya W. Bates

(57) ABSTRACT

A process for emulsifying and burning a portion of heavy oil extracted from an underground reservoir, wherein the emulsified heavy oil is burned to generate steam and a caustic is used to aid in emulsifying the heavy oil.

20 Claims, 5 Drawing Sheets

PROCESS FOR PRODUCING HEAVY OIL

BACKGROUND OF THE INVENTION

1. Field of the Invention

Embodiments of the present invention relate generally to processes for producing heavy oil. Various embodiments of the present invention are particularly useful in producing heavy oil emulsions that can be used in boilers in steam assisted gravity drainage (SAGD) processes for recovering heavy oil.

2. Description of the Related Art

Heavy oil is naturally formed oil with very high viscosity but often contains impurities such as sulfur. While conventional light oil has viscosities ranging from about 0.5 centipoise (cP) to about 100 cP, heavy oil has a viscosity that ranges from 100 cP to over 1,000,000 cP. Heavy oil reserves are estimated to equal about fifteen percent of the total remaining oil resources in the world. In the United States alone, heavy oil resources are estimated at about 30.5 billion barrels and heavy oil production accounts for a substantial portion of domestic oil production. For example, in California alone, heavy oil production accounts for over sixty percent of the states total oil production. With reserves of conventional light oil becoming more difficult to find, improved methods of heavy oil extractions have become more important. Unfortunately, heavy oil is typically expensive to extract and recovery is much slower and less complete than for lighter oil reserves. Therefore, there is a compelling need to develop a more efficient and effective means for extracting heavy oil.

Heavy oil that is too deep to be mined from the surface may be heated with hot fluids or steam to reduce the viscosity sufficiently for recovery by production wells. One thermal method, known as steam assisted gravity drainage (SAGD), provides for steam injection and oil production to be carried out through separate wells. The optimal configuration is an injector well which is substantially parallel to and situated above a producer well, which lies horizontally near the bottom of the formation. Thermal communication between the two wells is established by preheating the area between and around the injector well and producer well. Generally, such preheating is by steam circulation until the reservoir temperature between the injector and producer wellbore is at a temperature sufficient to drop the viscosity of the heavy oil so that it has sufficient mobility to flow to and be extracted through the producer well. Typically, preheating involves introducing steam through both the injector well and producer well. Steam circulation through the injector well and producer well will occur over a period of time. At some point before the circulation period ends, the temperature midway between the injector and producer will reach about 80 to 100° C. and the heavy oil will become movable (3000 cP or less). Once this occurs, the steam circulation rate for the producer well will be gradually reduced while the steam rate for the injector well will be maintained or increased. This imposes a pressure gradient from high, for the area around the injector well, to low, for the area around the producer well. With the oil viscosity low enough to move and the imposed pressure differential between the injection and production wellbores, steam (usually condensed to hot water) starts to flow from the injector into the producer. As the steam rate is continued to be adjusted downward in the producer well and upward in the injector well, the system arrives at steam assisted gravity drainage operation with no steam injection through the producer well and all the steam injection through the injector well. Once hydraulic communication is established between the pair of injector and producer wells, steam injection in the upper well and liquid production from the lower well can proceed. Due to gravity effects, the steam vapor tends to rise and develop a steam chamber at the top of the region being heated. The process is operated so that the liquid/vapor interface is maintained between the injector and producer wells to form a steam trap which prevents live steam from being produced through the producer well.

Once the formation has been preheated, SAGD operation can commence. In operation of the SAGD process, steam will come into contact with the heavy oil in the formation and, thus, heat the heavy oil and increase its mobility by lessening its viscosity. Heated heavy oil will tend to flow downward by gravity and collect around the producer well. Heated heavy oil is produced through the producer well as it collects. Steam contacting the heavy oil will lose heat and tend to condense into water. The water will also tend to flow downward toward the producer well and is produced with the heavy oil. Such produced water may be treated to reduce impurities and reheated in the boiler for subsequent injection.

Steam-based heavy oil recovery processes, such as SAGD processes described above, are most likely to burn natural gas as the fuel of choice to produce high-pressure steam for bitumen recovery. Steam requirements for such processes are on the order of two to five times as much steam as recovered oil. Thus, the cost of producing steam is one of the greatest operating expenses of recovery; the overall cost is greatly affected by the price of fuel used in producing steam. Thus, the use of natural gas as a fuel for producing steam reduces operating cost when the price of natural gas is low but these costs will increase proportionally as the price of natural gas increases. As a result, interest in alternative fuels is particularly kindled when the price of natural gas increases.

SUMMARY

In one embodiment of the present invention, there is provided a process for producing heavy oil from a subterranean region comprising withdrawing a heavy oil and water mixture from the subterranean region; separating at least a portion of the water from the heavy oil and water mixture to provide a first stream that contains the majority of the heavy oil from the heavy oil and water mixture and a second stream containing the portion of the water separated from the heavy oil and water mixture; emulsifying at least a portion of the first stream with a caustic and a surfactant and sufficient water, if any, from the second stream to produce an emulsified stream at the desired water content; introducing the emulsified stream as a fuel for a boiler to heat water and produce steam; and injecting the thus produced steam into the subterranean region.

In another embodiment of the present invention, there is provided a process for producing heavy oil from a subterranean region comprising: withdrawing a heavy oil and water mixture from the subterranean region; heating the heavy oil and water mixture; separating at least a portion of the water from the heavy oil and water mixture to provide a first stream that contains a majority of the heavy oil from the heavy oil and water mixture and a second stream containing the portion of the water separated from the heavy oil and water mixture; introducing a water stream into a boiler; splitting the first stream into a third stream and a fourth stream; adding a caustic to the fourth stream and sufficient water, if any, from the second stream to produce an emulsion at the desired water content, and emulsifying the thus resulting mixture to produce an emulsified stream; introducing the emulsified stream as a fuel for the boiler to thus heat the water stream and to produce steam; and injecting the thus produced steam into the subterranean region.

In still another embodiment of the present invention, there is provided the above processes where the water separated from the heavy oil and water mixture is heated in the boiler to produce steam and the steam is injected into the subterranean region to enhance heavy oil production.

BRIEF DESCRIPTION OF THE DRAWING FIGURES

Embodiments of the present invention are described in detail below with reference to the attached drawing figures, wherein.

NOTATION AND NOMENCLATURE

As used herein, the terms "a," "an," "the," and "said" means one or more.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

As used herein, the terms "comprising," "comprises," and "comprise" are open-ended transition terms used to transition from a subject recited before the term to one or elements recited after the term, where the element or elements listed after the transition term are not necessarily the only elements that make up of the subject.

As used herein, the terms "containing," "contains," and "contain" have the same open-ended meaning as "comprising," "comprises," and "comprise," provided below.

As used herein, the terms "having," "has," and "have" have the same open-ended meaning as "comprising," "comprises," and "comprise," provided above As used herein, the terms "including," "includes," and "include" have the same open-ended meaning as "comprising," "comprises," and "comprise," provided above.

As used herein, the term "heavy oil" means hydrocarbons having a viscosity from 100 cP to over 1,000,000 cP and generally includes bitumens, asphalts and tars.

As used herein, the term "oil-in-water emulsion" refers to a mixture that has a water continuous phase that contains droplets of oil.

As used herein, the term salt means primarily NaCl, but includes chlorides, carbonates, bicarbonates, bromides, sulfites, sulfates, and other anion species occurring in SAGD recycle water, along with any number of elemental cations, especially Na.

As used herein, the term "steam" refers to $H_2O$ in a gaseous state.

As used herein, the term "water" refers to $H_2O$ in a liquid state.

As used herein, the term "water-in-oil emulsion" refers to a mixture that has an oil continuous phase that contains droplets of water.

DETAILED DESCRIPTION

The following detailed description of various embodiments of the invention references the accompanying drawings which illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

Figure 1:
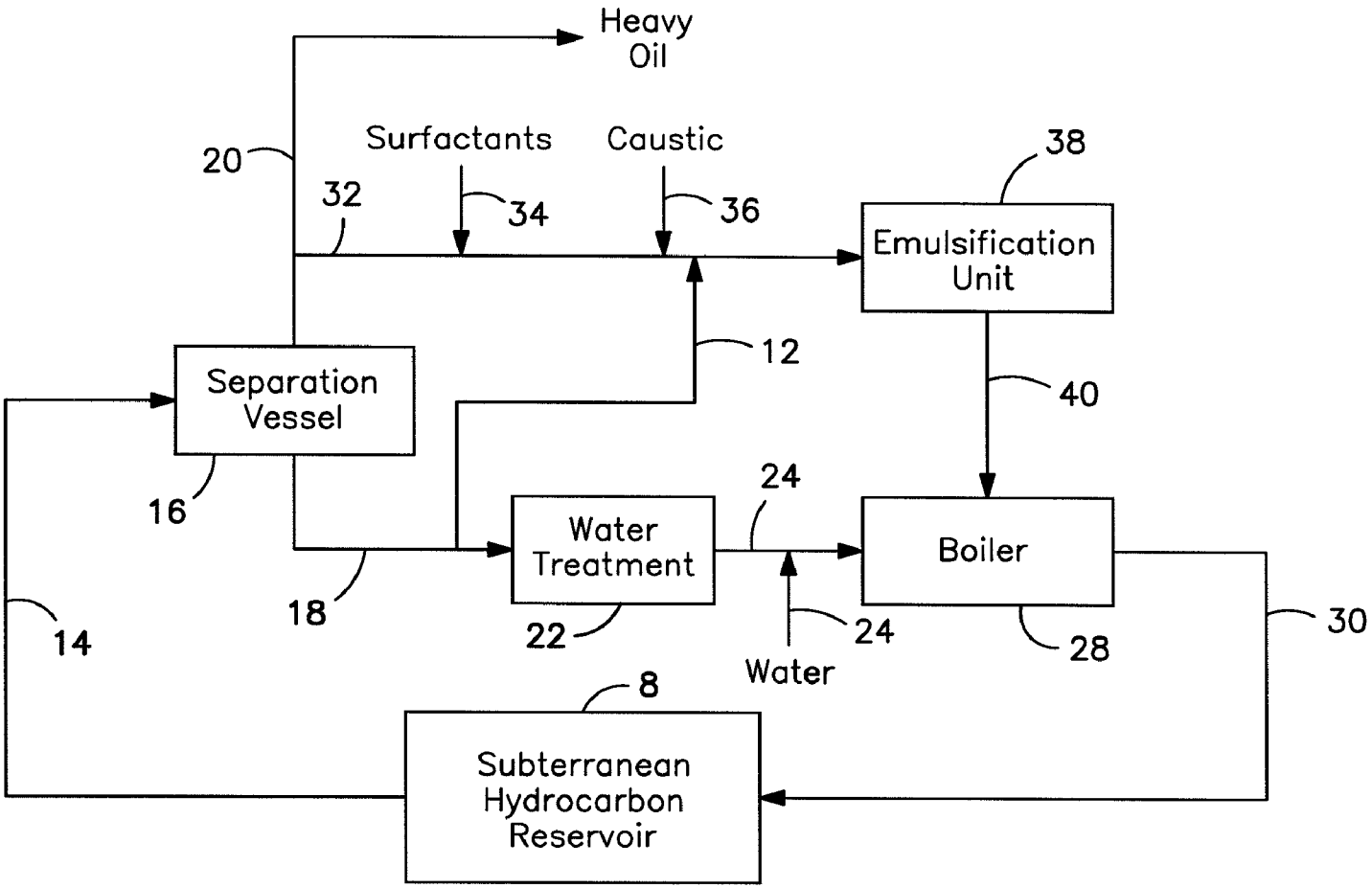
FIG. 1 is a schematic illustration of a process in accordance with the current invention.

Turning now to FIG. 1, an embodiment of a process in accordance with the current invention is illustrated. A heavy oil and water mixture are extracted from a hydrocarbon reservoir contained in a subterranean region (illustrated as Box 8). Preferably, the heavy oil and water mixture has a viscosity below 50 cp and more preferably to below 15 cp. Generally, this will bring the heavy oil temperature into the range of about 110° C. to 180° C. depending on its viscosity, hydrocarbon components and added diluent. If necessary, the heavy oil and water mixture may be heated to reduce its viscosity.

The heavy oil and water mixture having a suitable viscosity, as described above, is transferred to separation vessel 16 through conduit 14. Within separation vessel 16, the heavy oil and water are allowed to separate in separation vessel 16. Separation vessel 16 can be any suitable separation system for separating oil and water, such as a free water knock-out vessel for removal of free water followed by a treater vessel system comprising adding demulsifier chemicals, static or powered mixing and a treater vessel for a separation of water and oil. Separation vessel 16 will generally be about 130° C. at a pressure at least sufficient to keep the water phase liquid but may be 110° C. to 180° C. at a pressure at least sufficient to keep the water phase liquid. The water separated from the heavy oil is taken off through conduit 18 and the remaining heavy oil mixture is taken off through conduit 20. The heavy oil and water mixture entering separation vessel 16 will generally have a water content of greater than 40% by volume and more typically will be about 60% to 85% water by volume, not including any added diluent. The heavy oil mixture exiting separation vessel 16 through conduit 20 will generally have a water content of 40% or less by volume and preferably the water content will be from 20% to 40% by volume in order to achieve a suitable oil-in-water emulsion. If the water content is too low, then water may be added as described below.

The water exiting separation vessel 16 will contain impurities, most notably NaCl but others such as other salts, solids, silica and sand-related compounds and hydrocarbons. The water will generally be introduced by conduit 18 into a water treatment vessel 22. Optionally, a slipstream 12 could be removed from conduit 18 and supply water to the heavy oil in conduit 32 or emulsification unit 38 if more water is needed for emulsifying the bitumen. While it is desirable to treat the water to remove impurities, especially the more corrosive ones it is an advantage of this invention that need to remove the salt will we reduced or even eliminated. While the current invention will operate with water having lower salt content, it is also operable with the water having salt content greater than 4000 ppm. This advantage is two fold. The need to treat water supplied through conduit 12 is reduced or eliminated because the emulsions produced according to the current process are resistant to deterious effects of salt. Additionally, the necessity of treatment for water entering boiler 28 is reduced because of its reintroduction downhole.

Water coming from water treatment vessel 22 is introduced to boiler 28 through conduit 24. Within boiler 28, the water is heated to produce steam. The steam is then reintroduced to the hydrocarbon reservoir through conduit 30 for use in a SAGD type process. In addition to the water coming from water treatment vessel 22, make up water can be introduced into conduit 24 and, hence, boiler 28 through conduit 26. Optionally, instead of recycling water from water treatment vessel 22 to the boiler 28, all the water for the boiler can be supplied through conduit 26. However, this eliminates the benefit of recycling the water recovered from the reservoir.

The heavy oil mixture in conduit 20 is further processed and transferred to a pipeline or another transportation media. A portion of the heavy oil mixture is separate off from conduit 20 into conduit 32. Surfactants 34 and caustic 36 are introduced into the heavy oil mixture along with additional water from conduit 12, if necessary, to achieve the desired emulsion water content, and the combined stream is introduced into emulsification unit 38. Suitable emulsification units are known in the industry such as static mixers, pressure drop devices, powered mixers in pipes or vessels, and combinations of these techniques. Within the emulsification unit 38, the combined stream is treated to emulsify the heavy oil in the water. It is important that the conditions be sufficient to create an emulsion that is substantially an oil-in-water emulsion rather than a water-in-oil emulsion or a mixture of oil-in-water emulsions and water-in-oil emulsions. As illustrated in the examples below, sufficient surfactant and caustic should be added to ensure an oil-in-water emulsion is created.

It is an advantage of the current invention that the use of caustic increases the ability to form suitable emulsions in the presence of salt; thus, limiting the need to treat the heavy oil mixture or water to remove salt. Additionally, it has been found that the presence of group IIA ions, such as calcium and magnesium are undesirable and tend to make the emulsification more strongly favor the production of water-in-oil emulsions. Accordingly, the concentration of group IIA metal ions in the heavy oil stream going to emulsification unit 38 should be less than 250 ppm and more preferable less than 30 ppm.

The heavy oil emulsion removed from emulsification unit 38 should have an average droplet size of less than 20 microns. It has been discovered that suitable droplet size can be achieved for emulsions using caustic only or caustic and surfactant.

The heavy oil emulsion is removed from emulsification unit 38 through conduit 40 and introduce into boiler 28. Within boiler 28 the heavy oil emulsion is burned as fuel to generate heat to heat water introduced into the boiler through conduit 24.

Suitable caustics for use in making the heavy oil emulsion include, but are not limited to, NaOH, KOH, and $NH_4OH$.

Suitable surfactants for us in making the heavy oil emulsions may be chosen from non-ionic, anionic, cationic, amphoteric surfactant and mixtures of one or more thereof. It is presently preferred to use non-ionic surfactants. In particular, it is preferred to use one or more non-ionic surfactants chosen from the following:

Polyethylene glycol sorbitan monolaurate; Polyoxyethylenesorbitan monopalmitate; Polyethylene glycol sorbitan monostearate; polyoxyethylenesorbitan monooleate; Polyoxyethylenesorbitan trioleate; Octylphenoxypolyethoxyethanol; tert-Octylphenoxy Polyethyl Alcohol; Polyoxyethylene(30) octylphenyl ether; tert-Octylphenoxy Polyethyl Alcohol; Polyethylene glycol tert-octylphenylether; Polyethylene glycol tert-octylphenyl ether; Polyoxyethylene(23) lauryl ether; Polyethylene glycol hexadecyl ether; Polyethylene glycol oxtadecyl ether; Polyoxyetehylene(20) oleyl ether; jklPolyoxyethylene(100) stearyl ether; Polyoxyethylene (12) isooctylphenyl ether; Polyoxyethylene(40) nonylphenylether; and Polyoxyethylene(150) dinonylphenyl ether.

EXAMPLES

All of the emulsions in these examples were made in a Waring Blender Model 30-60. The blender was mounted in a stand along with a controller both made by Chandler Engineering. The rig in total was designated as a Chandler Model 3060-110V Mixer. The blender set-up uses open-top SS mixing cups with about 200-250 ml volume and a 'chop' style propeller in the bottom.

Samples of bitumen were weighed into the mixing cups and placed in a temperature-controlled hot water bath, normally at 80° C. The surfactants and salt amounts were added to the pre-weighed water and mixed before addition on top of the bitumen in the mixing cup. A watch glass was placed over the mixing cup to minimize the evaporative water loss. The mixing cups were allowed to stand in the heating bath for 30 minutes before placing them in the Chandler Mixing Stand and spinning them, usually at 6000 rpm for 20 seconds. The emulsions were allowed to cool down for about 2 hours before making qualitative observations. Occasionally, microscope pictures were taken to verify the emulsion and the droplet size. Sometimes a particle size measurement was taken on a Malvert Instrument after the samples were diluted 100:1 with water.

1. Making Oil-in-Water Emulsions

The following conditions were met for making the oil-in-water emulsion.

| | | |
|---|---|---|
| Temperature: | Sufficient for oil viscosity <1000 cp (80° C. was used for most of these bitumen runs) | |
| Mixer Speed: | 3000 rpm minimum 6000 rpm normally using a 2.5" 'chop' blade in 200 ml Waring Open-Top Mixing Cup | |
| Mixing Time: | 5 seconds minimum, normally 20 seconds | |
| Water Content: | 30 wt-% preferred for emulsion viscosity and stability, 20% minimum | |
| Surfactant: | Caustic: | 50-100% of the TAN titration value for up to 4,000 ppm NaCl water |
| | Non-ionic surfactant: | 2000-3000 ppm for up to at least 10,000 ppm NaCl water Various combinations of caustic and non-ionic surfactant depending on saltwater. |

2. Properties of the Oil-in-Water Emulsions

Almost all of the emulsions made by the above technique had an average droplet size, or Dp50, of 6-10 microns with a Dp10 of 3-5 microns and a Dp90 of 15-35 microns.

The viscosity of the oil-in-water emulsions is highly dependent on the water content of the emulsion, but with 30 wt-% water, an emulsion with a temperature in the range of 30° C. to 70° C. flows freely into a burner tip. A water content of 25% could be used if the emulsion temperature was about 40° C. to 80° C. Velocity ranges were dependent on obtaining temperatures high enough to sufficiently lower the viscosity without being so high that the emulsion would break down.

The emulsions were stable for at least 3 weeks without breaking into two phases though some gentle stirring was necessary to re-mix a think layer of water on top of the emulsion. The average particle size over the 3 week period increased only by 1 micron (see FIG. 5) which indicated good stability for the short times necessary for on-site combustion in accordance with the current invention.

Example 1

A bitumen sample having a Total Acid Number (TAN) of 2.6 (2.6 mg of KOH were required to neutralize the acid species in 1.0 g of the bitumen) was utilized.

Emulsions were made utilizing various concentrations of salt in the water. The ability of the various caustics to make emulsions in the presence of salt was tested. The caustics tested were NaOH, KOH, and $NH_4OH$.

Figure 2:
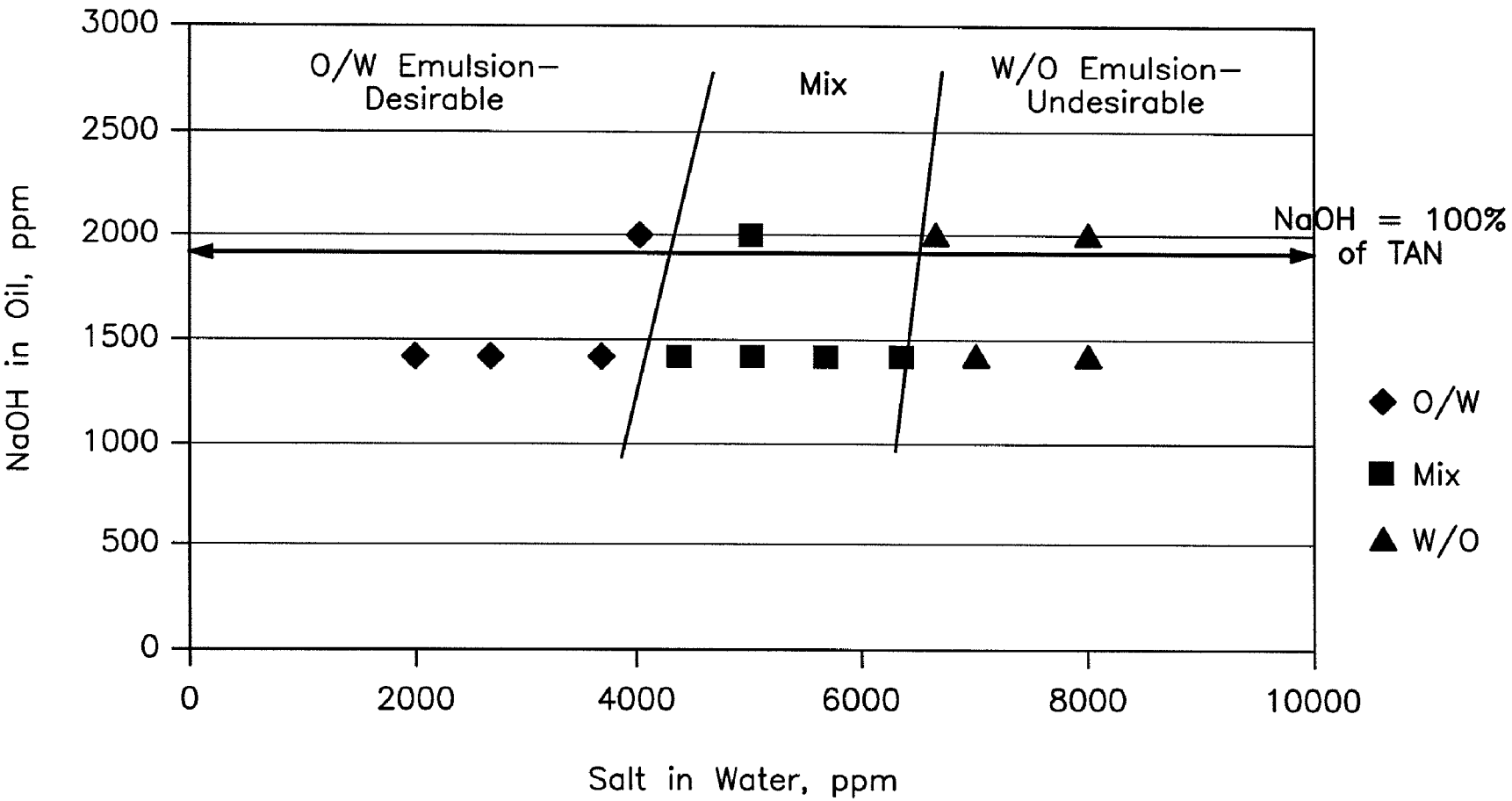
FIG. 2 is a phase diagram illustrating the results for a caustic used as an emulsifying agent for heavy oil in water containing salt.

A phase diagram illustrating the results for NaOH is shown in FIG. 2. As illustrated in the diagram NaOH can make emulsions up to approximately 4000 ppm salt in water.

KOH was similarly tested and the results indicated that KOH could make oil-in-water emulsions up to 5500 ppm salt in water.

$NH_4OH$ was similarly tested and the results illustrated that $NH_4OH$ made oil-in-water emulsions with pure water but did not make them with 4000 ppm salt water.

Example 2

Various commercial surfactants were tested utilizing various concentrations of salt in the water. Emulsions were made with and without caustics. The results indicated that the presence of the caustic did not lower the amount of surfactant necessary to make an oil-in-water emulsion but that the caustic made the emulsion more stable and less likely to separate into two phases over time.

Figure 3:
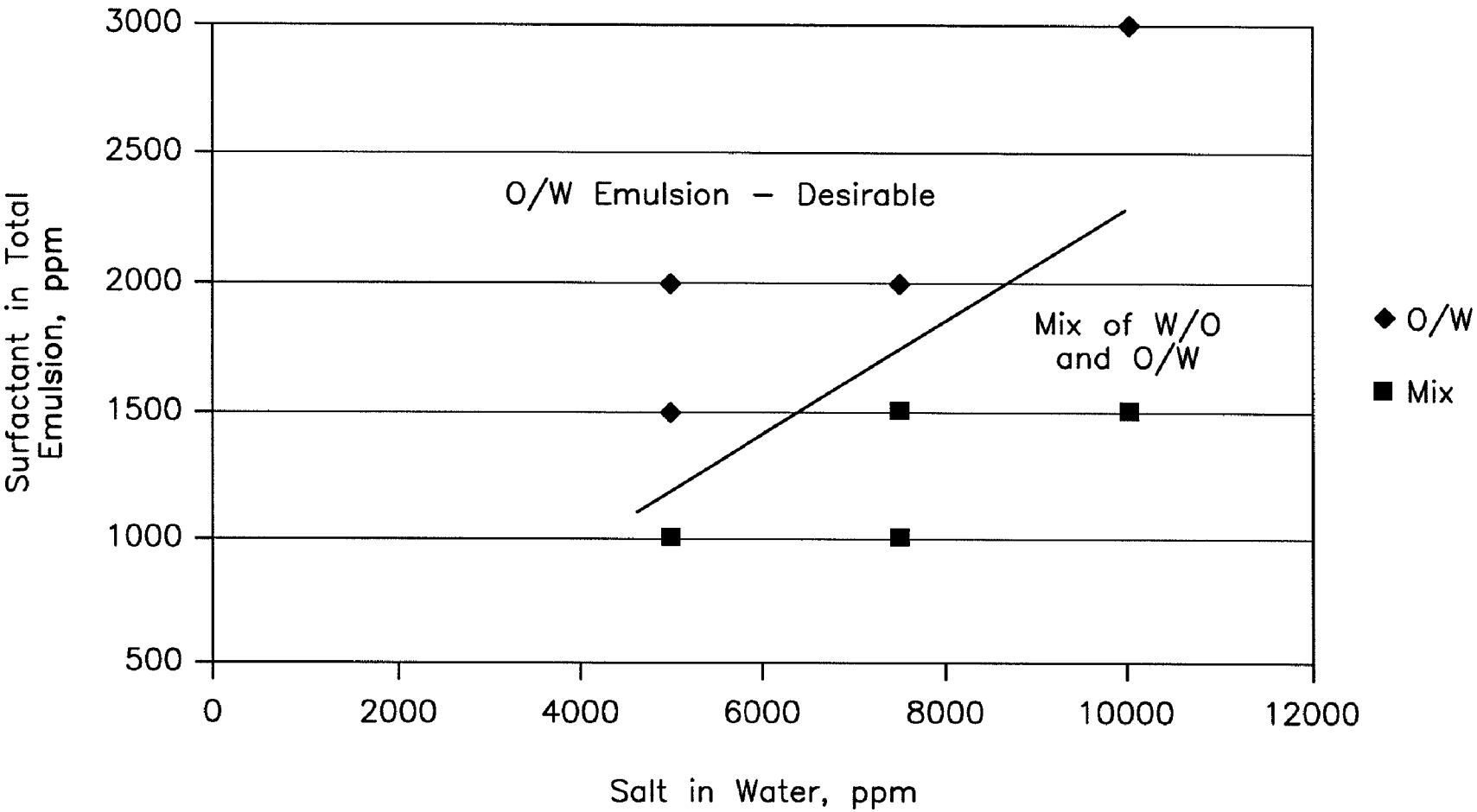
FIG. 3 is a phase diagram illustrating the results for a surfactant used as an emulsifying agent for heavy oil in water containing salt.
Figure 4:
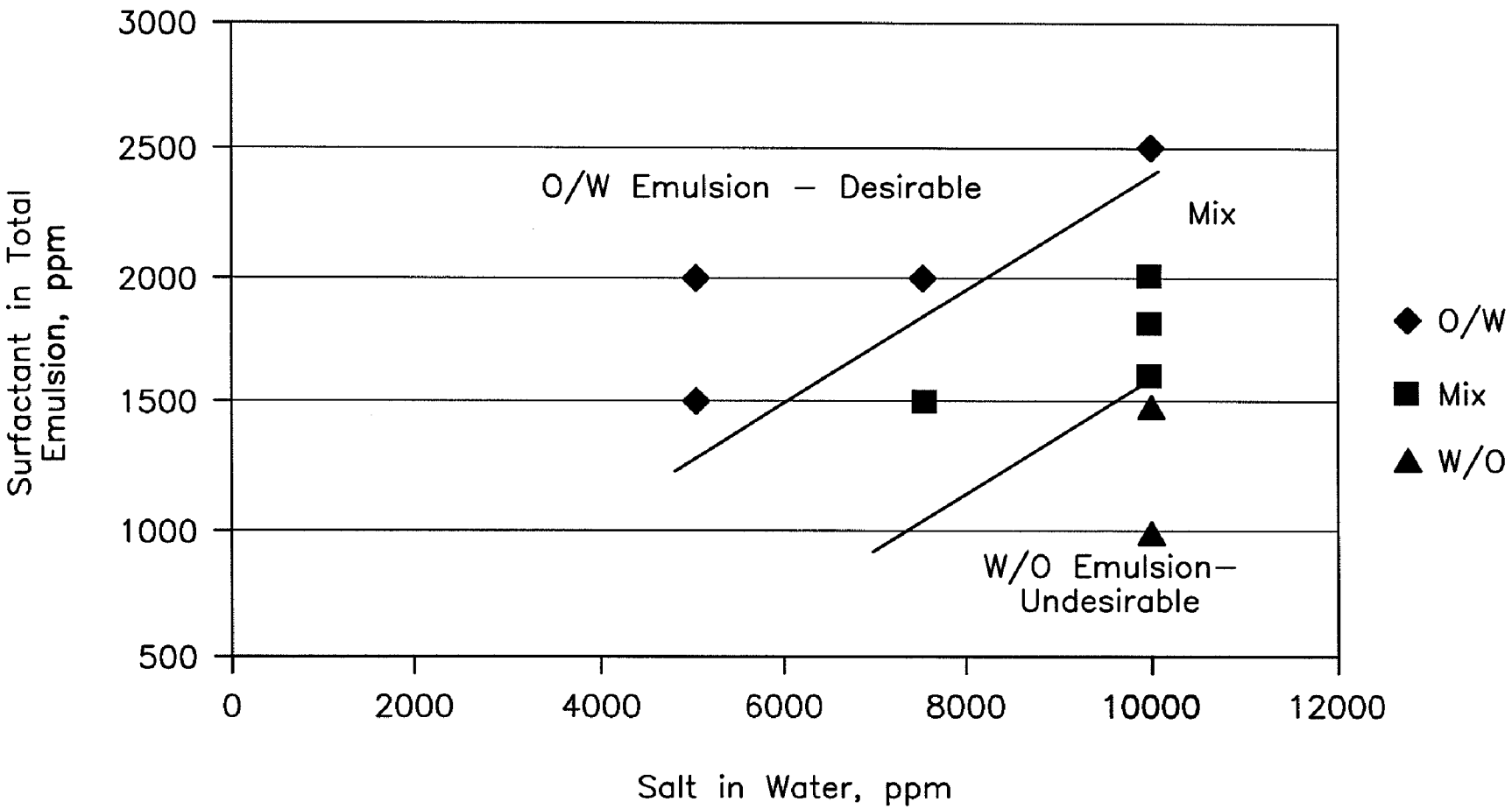
FIG. 4 is a phase diagram illustrating the results for a surfactant and a caustic used as emulsifying agents for heavy oil in water containing salt.
Figure 5:
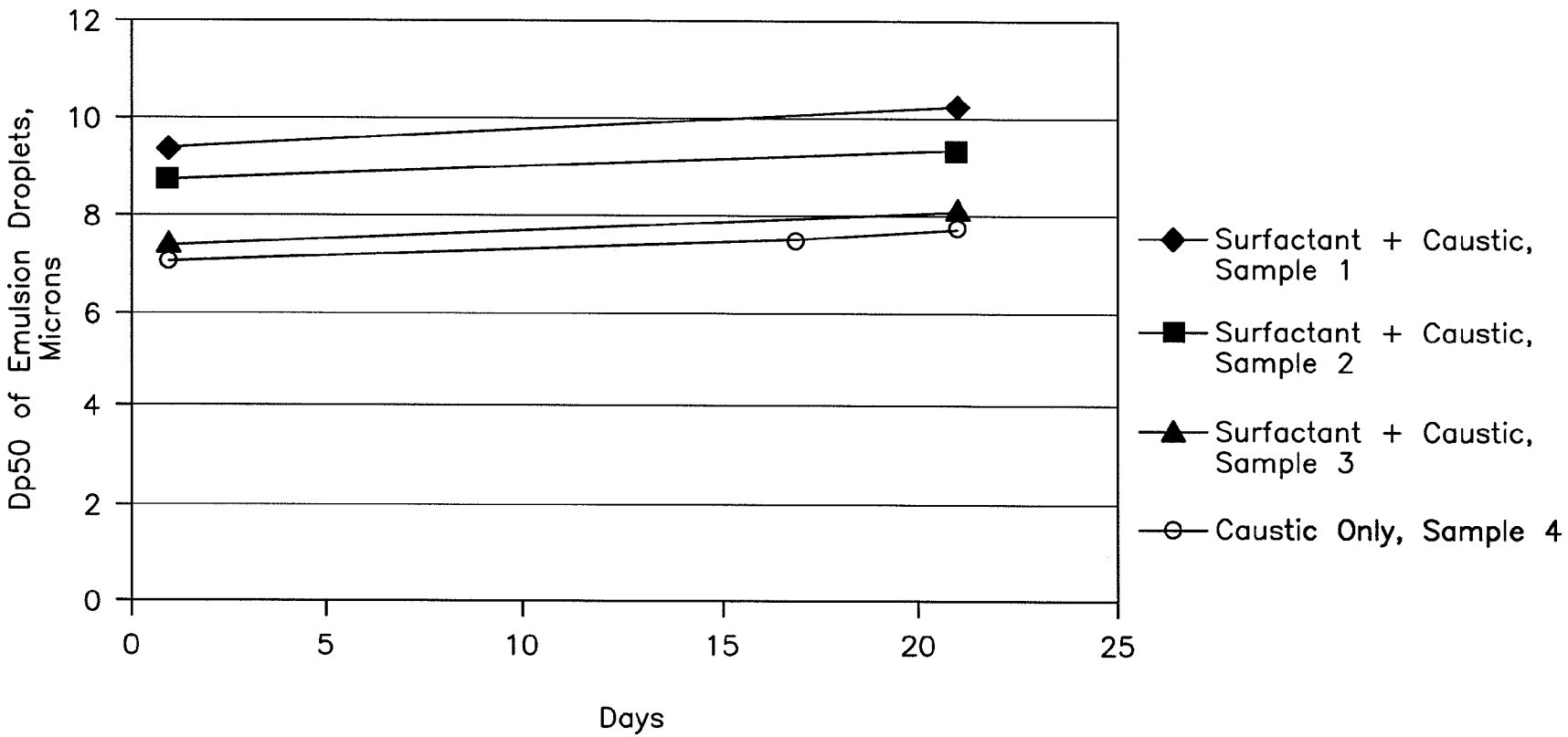
FIG. 5 illustrates the stability of emulsified heavy oil in water where a caustic is the emulsifying agent both alone and with a surfactant.

Exemplary results can be seen in FIGS. 3, 4 and 5 which show the results for the surfactant polyethylene glycol sorbitan monolaurate (PGSM). FIG. 3 is a phase diagram for emulsions made using PGSM and no caustic versus various concentrations of salt. FIG. 4 is a similar phase diagram for emulsions made using PGSM and caustic. FIG. 5 illustrates the stability of emulsions made with PGSM and caustic and with caustic alone. The emulsions in FIG. 5 were prepared from 0.06 g NaOH in 100 g total solution (70 g heavy oil and 30 g water) and contained 3000 ppm PGSM. The amount of caustic added equated to 46% of the heavy oil's TAN value.

The preferred forms of the invention described above are to be used as illustration only, and should not be used in a limiting sense to interpret the scope of the present invention. Modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as it pertains to any apparatus not materially departing from but outside the literal scope of the invention as set forth in the following claims.

That which is claimed:

1. A process for producing heavy oil from a subterranean region comprising:

withdrawing a heavy oil and water mixture from said subterranean region;

heating said heavy oil and water mixture;

separating at least a portion of the water from said heavy oil and water mixture to provide a first stream that contains a majority of the heavy oil from said heavy oil and water mixture and a second stream containing said portion of the water;

introducing a water stream into a boiler;

splitting said first stream into a third stream and a fourth stream;

adding a caustic to said fourth stream and emulsifying the thus resulting mixture to produce an emulsified stream;

introducing said emulsified stream as a fuel for said boiler to thus heat said water stream and to produce steam; and injecting the thus produced steam into said subterranean region.

2. The process of claim 1 further comprising introducing a portion of said second stream into said fourth stream.

3. The process of claim 2 wherein said heavy oil and water mixture is greater than 40% water by volume and the fourth stream is 40% or less water by volume.

4. The process of claim 3 wherein said heavy oil and water mixture is from 70% to 85% water by volume and said fourth stream is from 20% to 40% water by volume.

5. The process of claim 4 wherein the water stream has a salt content that is greater than 4000 ppm $H_2O$.

6. The process of claim 4 wherein said water stream contains at least a portion of said second stream.

7. The process of claim 4 wherein the concentration of group IIA metal ions is less than 250 ppm in said fourth stream.

8. The process of claim 1 wherein said caustic and a surfactant are added to said fourth stream.

9. The process of claim 8 wherein said heavy oil and water mixture is greater than 40% water by volume and the fourth stream is 40% or less water by volume.

10. The process of claim 9 wherein said heavy oil and water mixture is from 70% to 85% water by volume and said fourth stream is from 20% to 40% water by volume.

11. The process of claim 8 wherein the water stream has a salt content that is greater than 4000 ppm $H_2O$.

12. The process of claim 8 wherein the concentration of group IIA metal ions is less than 250 ppm in said fourth stream.

13. The process of claim 8 wherein said water stream contains at least a portion of said second stream.

14. The process of claim 8 wherein said caustic and said surfactant are essentially the only compounds added to said fourth stream to produce said emulsified stream.

15. A process for producing heavy oil from a subterranean region comprising:

withdrawing a heavy oil and water mixture from said subterranean region;

heating said heavy oil and water mixture;

separating at least a portion of the water from the heavy oil and water mixture to provide a first stream that contains the majority of the heavy oil from said heavy oil and water mixture and a second stream containing said portion of the water;

introducing a first portion of said second stream into a boiler;

splitting said first stream into a third stream and a fourth stream, wherein said fourth stream has concentration of group IIA metal ions of less than 250 ppm;

adding a caustic, a surfactant and a second portion of said second stream to said fourth stream and emulsifying the thus resulting mixture to produce an emulsified stream, wherein said caustic, said surfactant and said portion of said second stream are essentially the only compounds added to said fourth stream to produce said emulsified stream;

introducing said emulsified stream as a fuel for said boiler to thus heat said first portion of second stream and to produce steam; and injecting said thus produced steam into said subterranean region.

16. The process of claim 15 wherein said heavy oil and water mixture is less than 40% water by volume and said portion of said first stream is 40% or less water by volume.

17. The process of claim 15 wherein said heavy oil and water mixture is from 70% to 85% water by volume and said portion of said first stream is from 20% to 40% water by volume.

18. The process of claim 15 wherein the concentration of group IIA metal ions is less than 250 ppm in said fourth stream.

19. The process of claim 15 wherein the water stream has a NaCl content that is greater than 4000 ppm $H_2O$.

20. A process for producing heavy oil from a subterranean region comprising:

withdrawing a heavy oil and water mixture from said subterranean region;

separating at least a portion of the water from said heavy oil and water mixture to provide a first stream that contains the majority of the heavy oil from said heavy oil and water mixture;

emulsifying at least a portion of said first stream with a caustic and a surfactant to produce an emulsified stream;

introducing said emulsified stream as a fuel for a boiler to heat water and produce steam; and injecting the thus produced steam into said subterranean region.

* * * * *